US005578774A

United States Patent [19]

Dickson, II

[11] Patent Number: 5,578,774

[45] Date of Patent: Nov. 26, 1996

[54] BODY FOR AN ELECTRONIC STRINGED INSTRUMENT ADAPTED TO PRODUCE BANJO TONES

[76] Inventor: George E. Dickson, II, 1224 Escalon Ave., Escalon, Calif. 95320

[21] Appl. No.: 534,329

[22] Filed: Sep. 27, 1995

[51] Int. Cl.[6] ..... G10D 1/10

[52] U.S. Cl. ..... 84/269; 84/267; 84/291

[58] Field of Search ..... 84/267, 269, 290, 84/291, 293

[56] References Cited

U.S. PATENT DOCUMENTS 5,406,874 4/1995 Witchel ..... 84/291

*Primary Examiner*—Patrick J. Stanzione
*Attorney, Agent, or Firm*—Claude A. S. Hamrick

[57] ABSTRACT

An electronic stringed instrument including a head formed of a front panel having a central opening therein and a back panel held in spaced-apart relationship by an elongated member extending therebetween and attached to one end of an elongated neck. A plurality of strings each have one end affixed to the neck and extend along the length thereof and across a bridge to an attachment point on the front panel. An electrical pickup is mounted on the elongated member beneath the strings and between the bridge and the neck and extends through the opening to a point proximate the strings. The instrument is particularly suited for manufacture from acrylic materials.

17 Claims, 3 Drawing Sheets

BODY FOR AN ELECTRONIC STRINGED INSTRUMENT ADAPTED TO PRODUCE BANJO TONES

BACKGROUND OF THE INVENTION

1. Field of the Invention

The present invention relates generally to a novel body configuration for an electronic stringed musical instrument. More particularly, the invention relates to an improved body for an electronic stringed instrument adapted to produce the musical sounds of a banjo.

2. Brief Description of the Prior Art

Prior art banjos consist of a drum and a neck. The drum generally includes a rim and a thin, flexible membrane which is tautly stretched over the rim. This tautly stretched diaphragm is commonly referred to as the "head" of the banjo. The neck is attached to and extends from the rim. A tailpiece is mounted to the side of the rim opposite to which the neck is attached. The strings are secured to the tailpiece, extend across the head and along the length of the neck, and are secured at the remote end of the neck by adjustable pegs. An additional string extends along only a portion of the neck and is secured by another adjustable peg. A bridge is placed between the strings and the head membrane to convey the vibration of the strings to the head, thereby achieving the tonal qualities of the banjo.

There have been many attempts to electrify the sounds of a banjo. A significant reason why these attempts have met without success is that banjos have substantially different operating characteristics in comparison with other musical instruments. A primary determinant of the acoustic properties of an instrument like a guitar or violin is the design of the resonating box. When the strings of such an instrument are plucked or strummed, the vibrations of the strings are transmitted to the resonating box, through a bridge. The vibrations that are induced in the box determine the characteristic sounds of the instrument. An electrical pickup element that is intended for use with an instrument of this type is designed to pick up the vibrations within the resonance box. Typically, the pickup element might comprise a piezoelectric crystal that is attached to one of the walls of the resonance box.

A banjo does not have a resonance box to determine its characteristic sounds. Rather, when the strings of the banjo are plucked, the strings induce vibrations in the bridge, which in turn are transmitted to the head to produce the desired sounds. In contrast with a number of other stringed instruments, the bridge of a banjo is not permanently secured to the head. It is merely held against the head by the tension of the strings. Consequently, when the head vibrates in response to the plucking of the strings, there is relative movement and change in tension between the head and the bridge. The bridge effectively "bounces" on the diaphragm. Thus, the elements of a banjo that produce its characteristic sounds interplay differently than those found in other stringed instruments.

Early attempts to electrically reproduce the sounds of a banjo involved placing a standard pickup element in contact with the head to detect its vibrations. One example of a pickup arrangement of this type is disclosed in Law U.S. Pat. No. 3,780,202. This patent discloses a bracket for adjustably positioning an electromagnetic pickup in any of a number of different positions against the back side of the head. Although this arrangement can detect the vibrations of the head, the sound which is ultimately reproduced does not have the same tonal properties as those of a banjo standing alone. The pressure of the pickup element against the head alters the acoustic properties of the instrument. In other words, the head is not free to vibrate as a whole in response to the motion of the bridge. Rather, some of its movement is dampened by the pickup element, which results in the production of a muffled sound. Another problem with this type of arrangement has been that it is sensitive to feedback.

For the very same reason, a number of other approaches in which the pickup is incorporated into the structure of the bridge are not considered to be totally successful when used in connection with a banjo. In one such arrangement a piezoelectric element forms a transverse layer of the bridge. This arrangement can be found in electric guitars, electropianos and the like, but it is not desirable for use in an acoustic instrument because it alters the acoustic properties of the instrument. More specifically, by substituting a layer of the piezoelectric material for the wood, plastic or other conventional material of a bridge, a discontinuity is introduced in the bridge and the transmission of the vibrations to the sound box or the banjo head is altered. Usually, this alteration results in a dampening of the acoustic tone of the instrument, rather than merely reporting it; and is therefore not suitable in those situations in which it is desirable to accurately reproduce the sounds of an acoustic musical instrument with electronic amplification. This arrangement is also sensitive to feedback.

Similarly, attempts to reproduce the sounds of a banjo by placing a piezoelectric element in a slot or recess within the bridge have been met without success. One such arrangement can be found in Shubb U.S. Pat. No. 4,450,744. For the very same reasons stated above, these arrangements do not provide the most accurate report of the instrument's sounds and have still been met with substantial feedback.

Another problem associated with acoustic instruments is that the materials used to make the instruments expand and contract with changing temperature, humidity, and pressure. This problem is especially significant in banjos since banjos are generally made of wood, and wood expands and contracts significantly with changing atmospheric conditions. Therefore, players find themselves tuning and re-tuning their instruments repetitively.

FIG. 1 illustrates a prior art banjo body 10 incorporating a pickup 19 on or in a bridge 18 to reproduce the instrument's sounds. The prior art banjo body 10 includes a rim 15 and a thin, flexible diaphragm 16 which is tautly stretched over the rim 15. A neck 14 with fretboard 28 is attached to and extends from the rim 15. A tailpiece 20 is mounted on the opposite side of the rim to which the neck 14 is attached. The strings 22 are secured to the tailpiece 20, extend across the head 16 and along the length of the neck 14, and are secured at the remote end of the neck 14 to a headstock 12. The strings 22 are secured to the headstock 12 by rotatable pegs or screws 13 that provide for individual adjustment of the tension of the strings. An additional string 24 of the banjo extends along only a portion of the neck and is secured by another adjustable peg 26. Each of the strings 22, 24 is spaced from and supported parallel to the head 16 by means of the bridge 18, which is held against the head by the tension of the strings 22, 24.

As each string of the instrument is strummed or plucked, it vibrates at a frequency determined by its size and effective length, i.e. the length of the portion of the string between the bridge 18 and the particular fret 28 on the neck 14 against which a player urges the string. These vibrations are induced in the bridge 18 which in turn transmits them to the head 16.

Since the bridge 18 basically rests on the diaphragm 16, as opposed to being permanently affixed to it, the bridge 18 effectively "bounces" on the diaphragm 16 fluctuating the tension at their interface. Because the pickup 19 is incorporated on or in the bridge 18, the head 16 is not free to vibrate as a whole in response to the motion of the bridge. Rather, some of its movement is dampened by the pressure of the pickup element 19, which results in the production of a muffled sound.

SUMMARY OF THE INVENTION

It is therefore a principal objective of the present invention to provide a novel body arrangement for a stringed musical instrument that is capable of providing electrified banjo tones.

It is another objective of the present invention to provide a musical instrument that is not met with feedback problems.

It is another objective of the present invention to provide a musical instrument that exhibits improved tuning characteristics.

It is another objective of the present invention to provide a musical instrument that can be easily fabricated.

It is another objective of the present invention to provide an instrument that does not expand and contract significantly with changing temperature, humidity and pressure.

Briefly, a preferred embodiment of an electronic stringed musical instrument of the present invention comprises a head having a front panel and a back panel. The front panel has an outer edge and an inner edge that defines an opening through the approximate center of the front panel. The outer perimeter of the back panel is about the same shape as the outer edge of the front panel. The body further includes means for attaching the back panel in parallel spaced apart relationship to the front panel, the space therebetween remaining open. In other words, there is no rim. The means for attaching also includes an elongated member disposed between the front and back panels and extending from one side thereof to the other. A neck has its proximal end rigidly attached to one end of the elongated member and extends outward from the head. Several strings are coupled from the distal portion of the neck to an end of the elongated member opposite the one end attached to the neck. A bridge is mounted to the elongated member for supporting the strings. At least one pickup is mounted on the elongated member under the strings for sensing the vibrations of the strings.

The stringed musical instrument may be adapted to reproduce the sounds of a banjo. The bridge may be frictionally held in place between the strings and the elongated member by the tension of the strings. A preferred embodiment of the present invention fabricates the head and neck with substantially all acrylic material. The acrylic material may be translucent so that light directed at it can be reflected and refracted to produce a visually-pleasing display. The acrylic neck may include a fretboard surface and at least two flat surfaces defining the backside of the neck so that light directed at the neck is reflected by the fretboard and the interior sides of the flat surfaces. A handrest may also be mounted on the back panel and extend upward into the opening to provide a handrest below the strings.

An important advantage of the present invention is that the novel body configuration is capable of providing electrified banjo tones.

Another advantage of the present invention is that the instrument is not met with feedback problems.

Another advantage of the present invention is that the instrument exhibits improved tuning characteristics.

The main advantages of using an acrylic body include its ability to reflect and refract light. Acrylic can be easily molded into a variety of shapes and sizes. Acrylic is light weight. Acrylic is not sensitive to temperature, humidity and pressure variations.

These and other objects and advantages of the present invention will become apparent to those skilled in the art after taking into account the following drawings, detailed description of a preferred embodiment and the appended claims.

IN THE DRAWING

DETAILED DESCRIPTION OF A PREFERRED EMBODIMENT

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
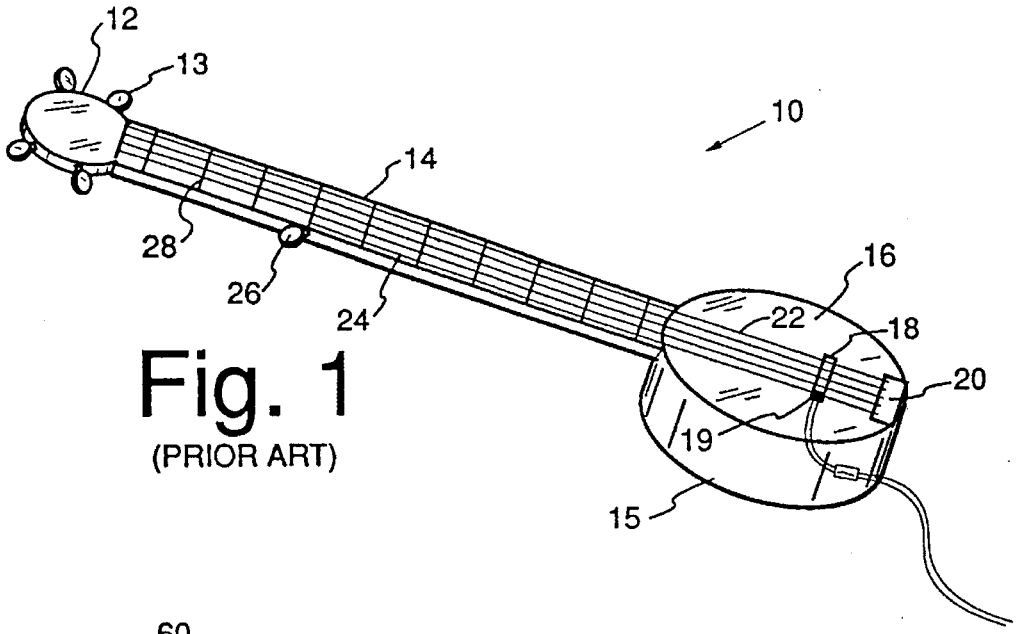
Fig. 1 (PRIOR ART)
FIG. 1 is a perspective view of a prior art banjo incorporating a bridge and pickup element.
Figure 2:
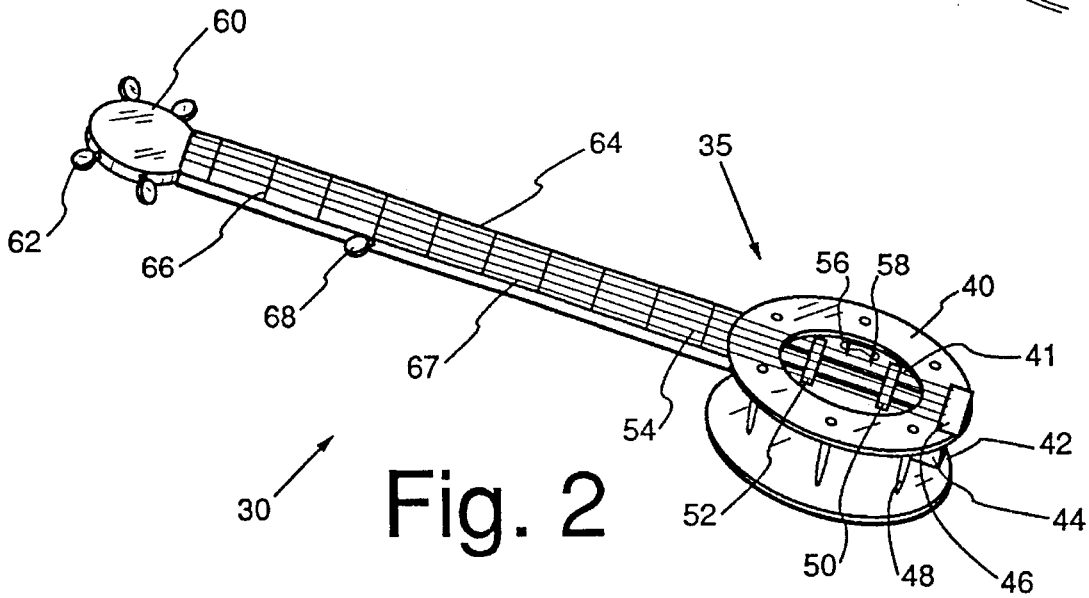
FIG. 2 is a perspective view of the body of an electronic stringed instrument in accordance with one embodiment of the present invention.

FIG. 2 illustrates a perspective view of a body configuration 30 of an electronic stringed instrument in accordance with a preferred embodiment of the present invention. It will be obvious to those skilled in the art that the tonal characteristics of the instrument depend both upon the materials used and the dimensions of the body 30.

The body configuration 30 includes a novel head 35. The novel head 35 comprises a front panel 40 and a back panel 42. The front panel 40 has an outer edge that defines the shape of the front panel 40 and an inner edge that defines the shape of an opening 41 through the approximate center of the front panel 40. The outer perimeter of the back panel 42 is about the same shape as the outer edge of the front panel 40. The body 30 includes means for attaching the back panel 42 in parallel spaced apart relationship to the front panel 40, the space between the two panels 40, 42 remaining open. In other words, there is no rim to enclose the space between the panels 40, 42. As further illustrated in FIGS. 3–5, the means for attaching the front and back panels 40, 42 includes an elongated member 44 disposed between the front and back panels 40, 42 and extending from one side thereof to the other.

Referring to FIG. 2, the body 30 further includes a neck 64 having its proximal end rigidly attached to one end of the elongated member 44 and extending outward from the head 35. Several strings 54 are coupled from the distal portion of the neck 64 to an end of the elongated member 44 opposite the one end attached to the neck 64. More specifically, the strings 54 of the banjo are attached to a tailpiece 46 mounted to the elongated member 44, extend across the length of the head 35 and neck 64, and are secured to a headstock 60 mounted at the distal end of the neck 64. The strings 54 are secured to the headstock 60 by rotatable pegs or screws 62 that provide for individual adjustment of the tension of the strings 54. An additional string 67 of the banjo may extend along only a portion of the neck 64 secured by another adjustable peg 68. A bridge 50 is mounted on the elongated member 44 for supporting the strings 54 above the front panel 40. At least one pickup 52 is mounted on the elongated member 44 under the strings 54 for sensing the vibrations of the strings 54. When the strings 54 are plucked or strummed, the resulting vibrations are induced in the bridge 50 which in turn transmits them to the elongated member 44. Since the pickup 52, like the bridge 50, is mounted to the elongated member 44, the pickup 52 can accurately sense the movement of the strings 54 as it relates to the bridge 50.

The size and shape of the front and back panels 40, 42 and the opening 41 will determine the tonal characteristics of the instrument 30. It will be appreciated that the front and back panels 40, 42, as well as the opening 41 in the front panel can be formed in a variety of shapes and sizes. In a preferred embodiment, the front and back panels 40, 42 are round, flat disks, each having a radius to its outer circumference of about six (6) inches and a depth of about ⅓ inch. Preferably, the opening 41 in the front panel 40 has a radius of about 4.5 inches.

The opening 41 in the front panel 40 serves two significant functions. First, the opening 41 provides tonal access to the space between the front and back panels 40, 42. When the strings 54 are plucked or strummed, the resulting vibrations pass through the opening 41 to reverberate between the front and back panels 40, 42. Second, the opening 41 provides physical access to the elements which can be mounted on the back panel 42 or the elongated member 44, such as pickups 52, bridges 50 and handrests 56.

Figure 3:
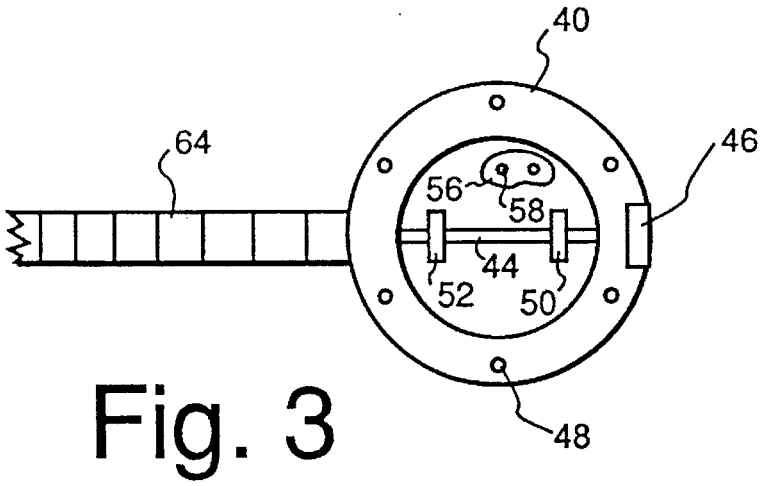
FIG. 3 is a top plan view of the head assembly in accordance with one embodiment of the present invention.
Figure 4:
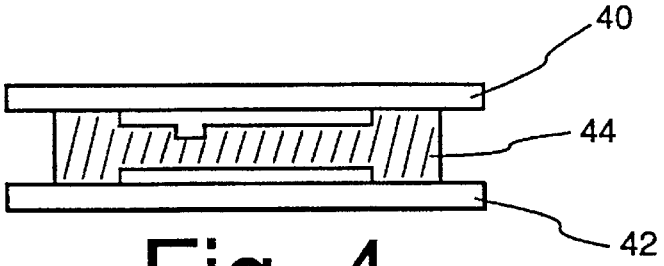
FIG. 4 is a side view of the elongated member in relation to the front panel and back panel in accordance with one embodiment of the present invention.
Figure 5:
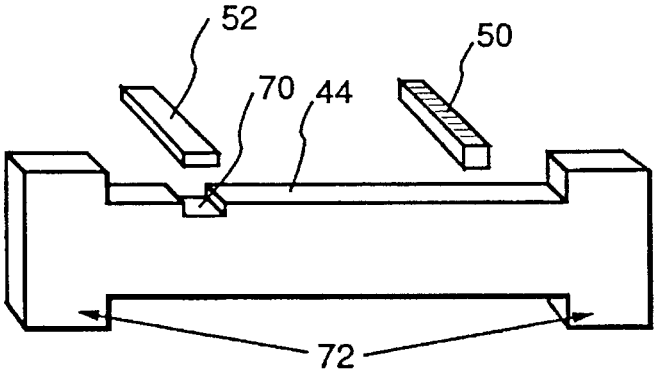
FIG. 5 is an exploded perspective view of the elongated member, pickup and bridge assembly in accordance with one embodiment of the present invention.

As illustrated in FIGS. 2–5, the means for attaching the back panel 42 in parallel spaced apart relationship to the front panel 40 includes an elongated member 44 disposed between the front and back panels 40, 42 and extending from one side thereof to the other. In the preferred embodiment where the front panel 40 is round, the elongated member 44 is disposed across a diameter of the front panel 40. The elongated member 44 is adapted to support elements, such as pickups 52 and a bridge 50, in such a manner that the elements can extend into the opening 41 in the front panel 40. By using means to attach the front and back panels 40, 42 without enclosing the space therebetween, it has been found that feedback has been eliminated and banjo tones may be achieved. The height of elongated member 44 defines the distance between the front and back panels 40, 42 and will directly affect the tonal characteristics of the instrument. Preferably, the height is between one (1) and three (3) inches, preferably around two (2) inches. As shown by FIGS. 4–5, the elongated member 44 may have cutouts on the upper and lower surfaces, thereby resulting in an elongated "H-shaped" member. When positioned between the front and back panels 40, 42, only the vertical portions 72 of the elongated "H-shaped" member 44 bear against the front and back panels 40, 42. It has been found that the "H-shape" of the elongated member 44 provides better tonal qualities than a straight elongated member 44. As illustrated in FIG. 5, the elongated member 44 may have a notch for mounting a pickup 52 therein.

As illustrated in FIG. 2, the present invention may include a bridge 50 that is frictionally held in place on the elongated member 44 by the tension of the strings. Preferably, a bridge as described in co-pending patent application, entitled "IMPROVED BRIDGE FOR STRINGED MUSICAL INSTRUMENTS", Ser. No. 08/391,927 filed Feb. 21, 1995, is used. Resting a bridge 50 on the elongated member 44, as opposed to permanently affixing it thereto, provides relative movement of the bridge 50 on the elongated member 44 during play of the instrument. This relative movement between the bridge 50 and elongated member 44 is similar to the movement of the bridge 18 and diaphragm 16 on a typical banjo and constitutes a major factor of the banjo tone of the preferred embodiment.

Figure 6:
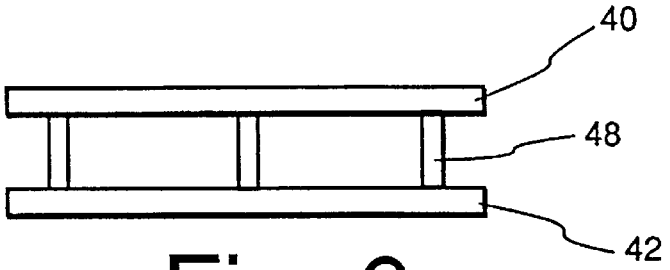
FIG. 6 is a side view depicting means for attaching the front and back panels in accordance with one embodiment of the present invention.

The means for attaching the back panel 42 in parallel spaced apart relationship to the front panel 40 may include a plurality of posts 48, as illustrated by FIGS. 2–3, 6. In a preferred embodiment, the back panel 42 is further secured to the front panel 40 by six (6) cylindrical posts 48, each having a diameter of about ⅜ inch and each mounted equidistant along a circular path near the outer circumference of the front panel 40. Other means may be used to further secure the front and back panels 40, 42 without enclosing the space therebetween, such as edge-clamps, trusses, or the like.

As illustrated in FIGS. 2–3, an embodiment of the present invention includes a handrest 56. Preferably, the handrest 56 is mounted on the back panel 42 using two (2) posts 58 and extends upward into the opening 41 to provide a handrest 56 below the strings 54.

FIG. 2 further illustrates a perspective view of a neck 64 of the present invention. The neck 64 includes a fretboard 66 and a headstock 60, the headstock 60 mounted at the distal end of the neck 64. The length of the neck 64 and the angle of the headstock 60 will affect the tonal characteristics of the instrument. A preferred embodiment includes a neck 64 having a length of about twenty-two (22) inches and having a headstock 60 angled about twenty (20) degrees away from the fretboard 66. It has been found that this length neck 64 and angled headstock 60 provide better intonation for a banjo.

Figure 7:
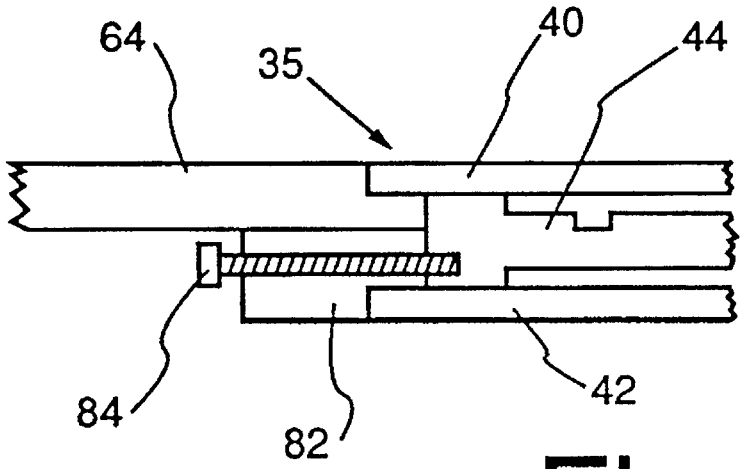
FIG. 7 is a side view of the relation between the elongated member and neck in accordance with one embodiment of the present invention.

One embodiment of the present invention rigidly attaches the neck 64 to the elongated member 44 using a bolt 84 and mounting means 82 assembly, as shown in FIG. 7. The mounting means 82 is adapted to bear between the neck 64 and the back panel 42 and to urge the neck 64 against the front panel 40. The neck is adapted to rest flush against the front panel. The neck 64 and mounting means 82 are attached together using a strong adhesive. A bolt 84 is used to secure the mounting means 82 to the elongated member 44. Additional adhesive may be used between the mounting means 82 and the back panel 42 and between the neck 64 and the front panel 40.

Figure 8:
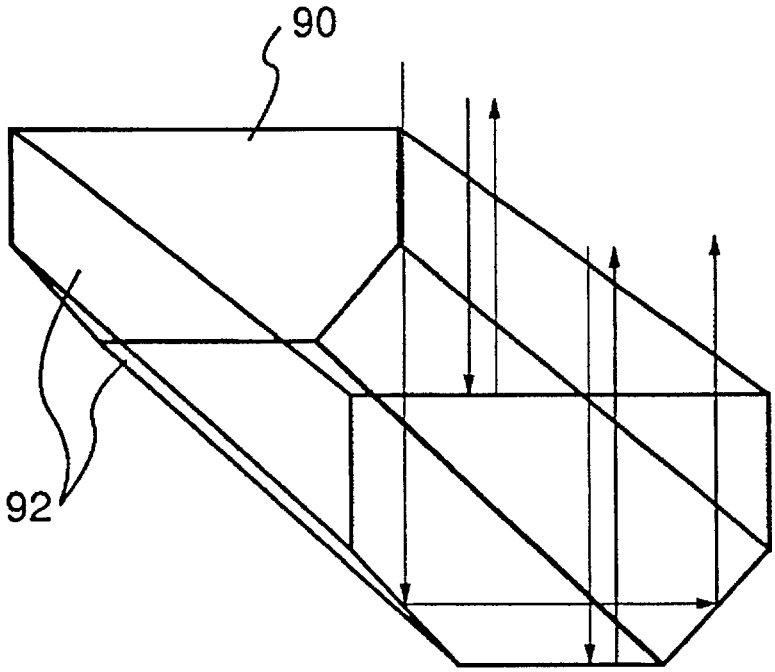
FIG. 8 is a perspective view of a portion of the neck in accordance with one embodiment of the present invention.

Another inventive aspect of the present invention includes the material used to fabricate the instrument. The body 30 of a preferred embodiment is made of substantially all acrylic. Use of acrylic has exhibited a several advantages. First, since acrylic is light weight, the acrylic instrument can be held by a player for extended periods of time. Second, since acrylic does not significantly expand and contract with changing temperature, humidity, and pressure, changing atmospheric conditions will not affect the length of the instrument. Therefore, the tension in the strings 54 will not change. Tuning and intonation will be insensitive to atmospheric conditions. Third, translucent acrylic of all colors has aesthetic qualities that include the ability to reflect and refract light. Thus, when a player is performing on stage, the instrument will reflect house lights back to the audience, thereby producing a visually-pleasing display. FIG. 8 depicts a preferred shape of the neck 64. The neck includes a top surface 90 designed to hold a fretboard 66 and a plurality of flat surfaces 92 defining the back side of the neck 64. Preferably, five flat surfaces 92 define the back side. A neck having a backside of this shape better reflects light directed toward the fretboard surface 66. The light that passes through the fretboard surface 66 will be reflected by the interior sides of the flat surfaces 92. The arrows in FIG. 8 illustrate a potential pattern of these reflections. It should be recognized that a neck 64 having a backside of any shape can be used.

It will be appreciated that the dimensions of the body as described by the preferred embodiments have been adapted to reproduce the sounds of a banjo without the problems encountered by the prior art. Since the head assembly does not have a typically enclosed resonating box or a drum, feedback has been effectively eliminated.

What is claimed is:

1. An electronic stringed musical instrument comprising:

(a) a head having a front panel and a back panel, the front panel having an outer edge and an inner edge, the inner edge defining an opening through the approximate center of the front panel, the outer perimeter of the back panel being about the same shape as the outer edge of the front panel;

(b) means for attaching the back panel in parallel spaced apart relationship to the front panel, the space therebetween remaining open, said means for attaching including an elongated member disposed between the front and back panels and extending across said space therebetween;

(c) a neck having its proximal end rigidly attached to one end of the elongated member and extending outward from the head;

(d) several strings, each string having a first and a second end, the first end of each string being coupled to the distal portion of the neck and the second end of each string coupled to an end of the elongated member opposite the one end;

(e) a bridge mounted to the elongated member and extending through said opening for supporting the strings; and (f) at least one pickup mounted on the elongated member under the strings for sensing the vibrations of the strings.

2. An electronic stringed musical instrument as recited in claim 1 wherein the stringed musical instrument is adapted to reproduce the sounds of a banjo.

3. An electronic stringed musical instrument as recited in claim 2 wherein the head and neck are made of substantially all acrylic.

4. An electronic stringed musical instrument as recited in claim 3 wherein the acrylic is translucent such that light directed at it is reflected and refracted to create a visually-pleasing display.

5. An electronic stringed musical instrument as recited in claim 4 wherein the neck has a fretboard surface and at least two flat surfaces defining the backside of the neck so that light directed at the fretboard is passed through the fretboard and is reflected by the interior sides of the flat surfaces.

6. An electronic stringed musical instrument as recited in claim 5 wherein the neck has more than two flat surfaces defining the backside of the neck so that light is internally reflected more than one time before passing out through the fretboard surface.

7. An electronic stringed musical instrument as recited in claim 2 wherein the bridge is frictionally held in place between the strings and the elongated member by the tension of the strings.

8. An electronic stringed musical instrument as recited in claim 2 wherein the front panel is round with a radius of about 6 inches and the opening therein is round with a radius of about 4.5 inches.

9. An electronic stringed musical instrument as recited in claim 1 wherein the elongated member has an upper and lower surface, and a cutout on each of the upper and lower surfaces thereby resulting in an elongated "H-shaped" member.

10. An electronic stringed musical instrument as recited in claim 1 wherein the elongated member is about 2 inches in height.

11. An electronic stringed musical instrument as recited in claim 1 further comprising a handrest mounted on the back panel and extending upward into the opening to provide a handrest below the strings.

12. An electronic stringed musical instrument adapted to reproduce the sounds of a banjo comprising:

(a) a head having a front panel and a back panel, the from panel having an outer edge and an inner edge, the inner edge defining an opening through the approximate center of the front panel, the outer perimeter of the back panel being about the same shape as the outer edge of the front panel;

(b) a plurality of posts for mounting the back panel parallel to and at a distance from the front panel such that the space therebetween remains open;

(c) an elongated member positioned between the front panel and the back panel and extending across said space therebetween;

(d) a neck extending outward from and collinear with the elongated member;

(e) several strings, each string having a first and a second end, the first end of each string coupled to the distal portion of the neck and the second end of each string coupled to the elongated member;

(f) a bridge mounted on the elongated member and extending through said opening for supporting the strings above the front panel; and (g) at least one pickup mounted on the elongated member for sensing the vibrations of the strings.

13. An electronic stringed musical instrument as recited in claim 12 wherein the head and neck are made of substantially all acrylic.

14. An electronic stringed musical instrument as recited in claim 12 further comprising a handrest mounted on the back panel and extending upward into the opening to provide a handrest below the strings.

15. An electronic stringed musical instrument as recited in claim 12 wherein the elongated member is about 2 inches in height.

16. An electronic stringed musical instrument as recited in claim 12 wherein the front panel is round with a radius of about 6 inches and the opening therein is round with a radius of about 4.5 inches.

17. An electronic stringed musical instrument as recited in claim 12 wherein the elongated member has an upper and lower surface, and a cutout on each of the upper and lower surfaces thereby resulting in an elongated "H-shaped" member.

* * * * *